US007360561B2

(12) United States Patent
Döhler

(10) Patent No.: US 7,360,561 B2
(45) Date of Patent: Apr. 22, 2008

(54) FABRIC FOR EMBROIDERING WITH REMOVABLE DELIMITATION

(75) Inventor: Ingo Döhler, Joinville (BR)

(73) Assignee: Dohler S/A, Joinville, Santa Catarina (BR)

( * ) Notice: Subject to any disclaimer, the term of this patent is extended or adjusted under 35 U.S.C. 154(b) by 224 days.

(21) Appl. No.: 10/992,558

(22) Filed: Nov. 18, 2004

(65) Prior Publication Data

US 2005/0112973 A1 May 26, 2005

(30) Foreign Application Priority Data

Nov. 21, 2003 (BR) ..... 0306379

(51) Int. Cl.
*D03D 15/00* (2006.01)

(52) U.S. Cl. ..... 139/420 R; 442/217; 442/301

(58) Field of Classification Search ..... 442/217, 442/301; 428/195.1, 196, 906.6; 139/420 R
See application file for complete search history.

(56) References Cited

U.S. PATENT DOCUMENTS 4,465,007 A * 8/1984 Strobel ..... 112/439

OTHER PUBLICATIONS

EP 0 393 450, Oct. 24, 1990 (English Translation).*

* cited by examiner

*Primary Examiner*—Jenna-Leigh Johnson
(74) *Attorney, Agent, or Firm*—Darby & Darby P.C.

(57) ABSTRACT

The present invention patent refers to a fabric for embroidering with removable delimitation that aims at simplifying and making the embroiderers' work easier, featuring a delimitation that consists of a yarn or filament in a different color from that of the remaining fabric for embroidering, in order to help in the embroidery's orientation and positioning.

3 Claims, 1 Drawing Sheet

FABRIC FOR EMBROIDERING WITH REMOVABLE DELIMITATION

Figure 1:
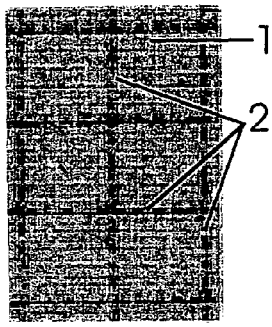

The present application claims priority under 35 U.S.C. § 119 to Brazilian Patent Application No. PI-0306379-8 filed on Nov. 21, 2003. The content of the application is incorporated herein by reference in its entirety.

FIELD OF THE INVENTION

The present invention patent refers to a fabric for embroidering with a removable delimitation yarn or filament, particularly to be used to make embroidering easier.

BACKGROUND OF THE INVENTION

Structured fabrics for embroidering, in the technique state, are already known, such as "Mock-Leno", also called Aida, Etamine, etc; they are commercialized as fabrics, borders, stripes and strips, among other structures.

Such fabrics, however, do not show any delimitation to help to position the embroidery, its format and size.

Without the help of guiding-lines, the user needs to count each stitch to be embroidered, or he/she must mark on the fabric by using specific markers for such purpose.

The lack of guiding-lines poses some inconveniences such as the difficulty to centralize/position the pattern to be embroidered, and, if there is a stitch miscount, it takes longer to spot the mistake, which is many times noticed only at the end of the job.

The existence of guiding-lines reduces the mistake possibility when embroidering and, if a mistake occurs, it is easily and quickly spotted.

Some products have been launched in the market to cover this deficiency, as for example the guiding-screen, among others. These products, however, have the inconvenience to be removed yarn by yarn after the embroidery is finished, what can move and consequently distort the embroidery's lines thus harming its appearance.

Some fabrics with colored dots marking out the places to be embroidered are also available in the market, as for example the heat transfer process, which is inconvenient because even after consecutive washes and use the dots remain indelible.

The present invention aims at simplifying and making embroidery/tapestry work easier, presenting a fabric for embroidering with removable delimitation, the guiding-line type, usually checked, whose removable yarn or filament is presented in a different color from that of the remaining fabric for embroidering, in order to help in the embroidery's orientation and positioning.

SUMMARY OF THE INVENTION

It is a fabric for embroidering with removable delimitation, featuring a removable yarn or filament in a different color from that of the fabric for embroidering, with normally regular spacing, horizontal, vertical, or checked, made of a material soluble or removable in liquid means, or by a physical/chemical process.

It is understood, according to the meaning used herein, that a removable material is the one that can be separable, soluble or any form that can destitute its integrity when in contact with liquids, usually water, or by a physical/chemical process.

Preferably, the fabric is the structured for embroidering type, also known as Aida or Etamine.

In the fabric's particular case, the present invention presents both in the weft's direction (fabric's transversal layer) and in the warp's direction (fabric's longitudinal layer), in normally regular spacing, at least one yarn or filament in a different color from that of the fabric, made of material removable in a liquid mean, or by a physical/chemical process.

Alternatively, a dye can be physically or chemically incorporated to a yarn or filament of the weft and of the warp, positioned in normally regular spacing, being of a different color of that of the fabric in order to mark it out. The aforesaid physical or chemical removal means may be of any kind, for example, light, heat, contact with liquid, abrasion, and others.

Such yarns, filaments, or dyes incorporated to the yarns or filaments of the weft and of the warp mark out the fabric in the desired arrangement, as guiding-lines. The aforesaid threads are of a different color of that of the fabric for embroidering, in order to make the embroidery's visualization easier. This delimitation is made in such a way to define a certain number of stitches within the area to be marked out.

The area to be marked out is usually a 10-stitch check, which is the standard of embroidery patterns.

The preferable liquid mean to remove the yarn or filament is water.

This innovation has several advantages. The fabric delimitation with removable yarns or filaments makes it easier to mark out the embroidering areas and spaces, besides making the designs' positioning and centralization easier. As they are yarns or filaments removable in a liquid mean or by a physical and/or chemical process, or because such yarns or filaments contain soluble dyers, they do not leave any marks on the fabric after being removed. When the fabric, in its preferential form, is provided with 10-stitch distance guiding-lines, it makes it possible to use any embroidery design diagram existing in the editorial market (leaflets, magazines, inserts, etc) thus reducing mistakes and, if they occur, they can be easily and quickly spotted.

The temporary yarn or filament is inserted to work as a guide to the embroidery maker who, after the embroidery is finished, removes it through a simple and accessible procedure to any user, by eliminating the temporary delimitation yarn or filament, which will leave no signs or marks of its previous presence. Similarly, when using yarns or filaments of the warp and weft that were dyed with removable dyers, the user embroiders guiding him/herself by the colored yarns. After that, the dyer is removed without leaving any signs on the fabric.

The temporary yarn or filament elimination happens due to its chemical constitution, which allows its complete removal (disintegration or dissolution) through the simple action of water, other liquids, or any other physical and/or chemical means, under pre-established times and temperature conditions.

In order to make the fabric, the yarns or filaments are woven according to the previously determined details of the warp and weft, in any arrangement or number for the temporary or permanent yarns or filaments that compose the warp(s), and they can be rolled in one or more warp rolls, according to the design programming.

After the weaving, the resulting fabric is then properly finished obtaining the touch and consistency that allows an easy execution of the embroidery.

If a non woven or a perforated film fabric is used, the temporary yarn or filament is preferably later incorporated to its manufacturing, preferentially in a uniform way, and in a different color from that of the fabric for a good visualization.

For example, when using temporary yarns or filaments after the execution of the embroidery, the user simply needs to dip the cloth in a hot water bath and/or other liquids, at a temperature between 55 to 88° C., from 5 to 15 minutes, what causes the total dissolution and complete disappearance of the temporary delimitation yarn or filament. The fabric has its final look, without any marks, showing just the embroidery made.

When using yarns or filaments with removable dyers, after the execution of the embroidery, the dyer is removed through any of the possible processes, such as by dipping it into water or other liquids, friction, light action, heat or other physical and/or chemical processes.

In an objective way, the invention comprises two alternatives: A fabric whose temporary delimitation is made with yarns or filaments removable in liquid means or by physical and/or chemical processes; and A fabric whose temporary delimitation is made with dyers removable in liquid means or by physical and/or chemical processes applied to the fabric's warp and weft.

The accomplishment process of this patent's object applies to state-of-the-art machines and operational systems. Nevertheless, it can be carried out in older similar manufacturing systems and it can be updated to future operational and manufacturing technologies, whenever necessary.

Schematic figures of a particular accomplishment of the invention, whose dimensions and proportions are not necessarily the actual ones because such figures intend only to didactically present the invention's several aspects, are as follows. The invention's protection range is determined only by the scope of the enclosed claims.

A BRIEF DESCRIPTION OF THE DRAWINGS

Figure 2:
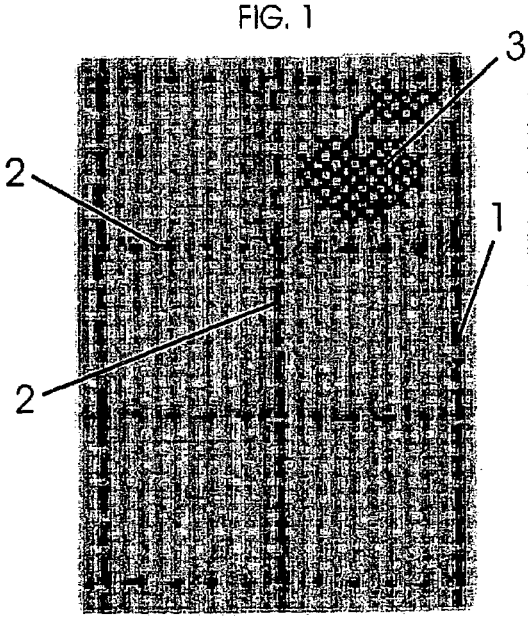
Figure 3:
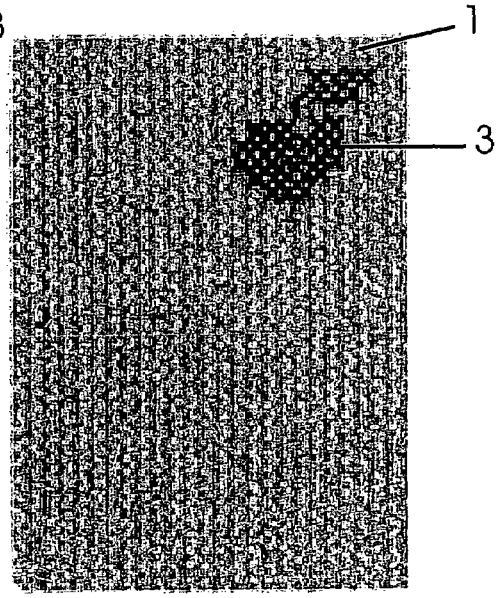

The invention shall be described based on the enclosed drawings, in which:

FIG. 1 provides a frontal view of the fabric for embroidering with temporary yarns or filaments delimiting it according to the present invention;

FIG. 2 provides a frontal view of the fabric for embroidering with the yarns or filaments helping to position the embroidery's design with respect to FIG. 2; and FIG. 3 provides a frontal view of the fabric for embroidering with the embroidery's design and the temporary yarns or filaments (2) already removed.

DETAILED DESCRIPTION OF THE PREFERRED EMBODIMENT

The following example is about a particular accomplishment of the invention, that is, a fabric for embroidering (1) with removable delimitation in the direction both of the warp and the weft, in normally regular spacing, having at least one yarn or filament (2) in a different color from that of the fabric, made of a material that can be dissolved in liquid means or by physical and/or chemical processes.

The temporary yarn or filament (2) aims at working as a guide to the embroidery maker (3), and as soon as the embroidery is finished the temporary yarn or filament is removed through a simple procedure, accessible to any user, without leaving any signs or marks of its previous presence. Similarly, when using yarns or filaments of the warp and weft that were dyed with removable dyers, the user embroiders guiding him/herself by the colored yarns. After that, the dyer is removed without leaving any signs on the fabric.

For example, when using temporary yarns or filaments after the execution of the embroidery (3), the user simply needs to dip the cloth in a hot water bath and/or other liquids, at a temperature between 55 to 88° C., from 5 to 15 minutes, what will cause the total dissolution and complete disappearance of the temporary delimitation yarn or filament. The fabric will then have its final look, without any marks, showing just the embroidery made (3).

As represented by FIGS. 1 and 2, the fabric (1) is marked out by filaments (2) which are perpendicularly set to form a checked area, thus helping to position and make embroideries (3).

FIG. 3 shows the finished embroidery (3) and the fabric (1) without the temporary yarns or filaments (2).

Technicians can promptly see, from the description and from the represented drawings, several ways to carry out the invention always within the enclosed claim scope.

The invention claimed is:

1. A fabric for embroidery with removable delimitation comprising:

a plurality of warp and weft yarns;

a visually differentiated yarn being made visually different from the other yarns through dyeing with a water-removable coloring material;

wherein the plurality of warp and weft yarns are woven together in a pattern, and after a specific number of warp and weft yarns are interwoven, a visually differentiated yarn is woven in, following the pattern, as at least one of a warp and weft yarns to form the fabric structure; and wherein the visually differentiated yarn remains in the structure of the fabric after said water-removable coloring material is removed.

2. A fabric for embroidery as defined in claim 1, wherein the visually differentiated yarn is woven in to form a grid pattern.

3. A fabric for embroidering with removable delimitation comprising:

a plurality of warp and weft yarns;

at least one visually differentiated yarn, said visually differentiated yarn being made visually different from the other yarns through dyeing with a water removable dyeing material;

said plurality of warp and weft yarns including said at least one visually differentiated yarn as at least one of a warp and weft yarns, to define an embroidering grid pattern;

said water removable dyeing material of the visually differentiated yarn being removed by washing the fabric after it has been embroidered without affecting any color used in the embroidering.

* * * * *